United States Patent [19]

Spofford

[11] Patent Number: 4,592,402

[45] Date of Patent: Jun. 3, 1986

[54] ADJUSTABLE MODULES

[76] Inventor: Charles J. Spofford, 59 Norwood St., Greenfield, Mass. 01301

[21] Appl. No.: 544,964

[22] Filed: Oct. 24, 1983

[51] Int. Cl.[4] ..... E04C 1/10

[52] U.S. Cl. ..... 144/346; 29/463; 29/155 R; 144/353; 144/355

[58] Field of Search ..... 52/455, 456, 313, 814, 52/98, 100, 105, 311, 585, 586; 49/55, 501, 505; 144/353, 346, 355; 29/463, 155 R

[56] References Cited

U.S. PATENT DOCUMENTS

| | | | |
|---|---|---|---|
| 656,390 | 8/1900 | Cordon . | |
| 660,308 | 10/1900 | Pixley . | |
| 682,322 | 9/1901 | Cronin | 52/455 |
| 1,540,482 | 6/1925 | Landaal . | |
| 2,886,860 | 5/1959 | Zern | 49/505 |
| 3,284,113 | 11/1966 | Howell . | |
| 3,313,199 | 4/1967 | Houvener et al. . | |
| 3,331,623 | 7/1967 | Baresel-Bofinger . | |
| 3,698,114 | 10/1972 | Hirsch et al. . | |
| 3,722,130 | 3/1973 | Handl . | |

*Primary Examiner*—Carl D. Friedman
*Assistant Examiner*—Creighton Smith
*Attorney, Agent, or Firm*—Donald S. Holland

[57] ABSTRACT

Adjustable modules are disclosed for building final products of various sizes from a single-sized, mass-produced unit. In the preferred embodiment, each module is made of mass-produced, left-hand and right-hand sections that are joinable at oppositely facing, abuttable ends by any suitable means—here, dowels that fit into aligned channel halves in the complemental faces of the two sections.

By utilizing the split-section aspect, the overall size of the final product, e.g., a door, can be reduced without detracting from the functional, and sometimes even ornamental, aspects of the modules. This is achieved by trimming back the modular sections along their complemental faces prior to joining the faces together.

4 Claims, 6 Drawing Figures

ADJUSTABLE MODULES

BACKGROUND OF THE INVENTION

This invention relates to wood and metal products and, more particularly, relates to mass-produced, prefabricated modules for making the products In the past, one-piece modules have been utilized to build final products, such as doors or drawers. For example, doors have been built with modular, vertically oriented stiles on both sides, wherein the stiles have a center panel fit between them by a tongue-and-groove arrangement, and wherein the top and bottom of the panel are capped with horizontal rails that are also attached by tongue-and-groove arrangements. The drawers can also be modular with each drawer's sides, front and back being prefabricated to a standard size. Each drawer piece is provided with mating channels at its ends, e.g., dovetail cutouts, for subsequent mating of the pieces and forming of the drawer's corners.

In order to reduce the size of the final products, these prior modules require trimming at their peripheries. This often destroys functional features along the module's rim, such as the tongue of a tongue-and-groove arrangement or the cutouts for a dovetail joint. For example, if a person wants to reduce the width of a drawer made with the prior art's prefabricated pieces, he needs to trim off an end from both the front and back panels of the drawer. In doing so, he also has to cut off the "joint" cutouts of both trimmed ends. Afterwards, the length of the front and back panels is reduced and the finished product will have a smaller width. However, before the panels can be assembled into a finished drawer, their trimmed rims have to be repaired or rebuilt so as to "put back" their functional features—here, the removed cutouts.

A similar problem arises with one-piece, final products that are not made of modules, such as wooden picture frames or doors with carved or routed designs. The outer dimensions of these products can only be reduced by cutting away from the products' outer edges or perimeters. This destroys the ornamental aspects along the edge, such as molding. Further, the functional aspects of the product can also be destroyed, as is the case when the product is a frame and cutting away of the frame's outer perimeter causes the frame's center mounting portion to be shifted out of its desired location.

Accordingly, it is the primary object of the present invention to introduce a new concept in modules for building final products, wherein the new concept permits a module to be easily trimmed and thereby reduced in length or width without destroying the functional aspects of the module along its rim.

It is another primary object to provide prefabricated, two-piece modules for building wood or metal products, wherein the size of the final product can be easily reduced by trimming away the modules at their centers, instead of at their peripheries, so as to reduce their lengths or widths but not destroy the functional aspects of the modules along their rims.

It is a more specific object to provide an adjustable module which is made of mass producible, left-hand and righthand sections that are joined at complemental, abutting ends by any suitable means (preferably dowels that fit into overlengthed channels in the complemental ends), wherein the overall length of the module can be reduced from its standardized or originally manufactured size by slicing the sections along their complemental faces prior to joining the faces together.

It is yet another object to provide two-piece modules, commensurate with the above-listed objects, wherein the size of some modules can be adjusted without destroying the ornamental aspects on their outer surfaces.

It is a further object to provide a new two-piece module which is simple to use, yet extremely durable and economical in design.

The above and other objects and advantages of this invention will become more readily apparent when the following description is read in conjunction with the accompanying drawings.

SUMMARY OF THE INVENTION

As described more fully in the detailed description that follows, the present invention comprises adjustable modules whose overall size can be adjusted without disturbing the modules' designs or functional aspects by trimming away the modules at their centers instead of at their outer peripheries, as has been done in the prior art.

Each adjustable module can be made of mass-produced, left-hand and right-hand sections that are aligned and joined at complemental ends by any suitable means (preferably dowels), wherein the module's overall size can be reduced by cutting the sections along their complemental faces prior to joining the faces together. By cutting back the modules in this manner, the overall size of the final product, e.g., a door, can be selected.

DETAILED DESCRIPTION OF THE PREFERRED EMBODIMENTS

Figure 1:
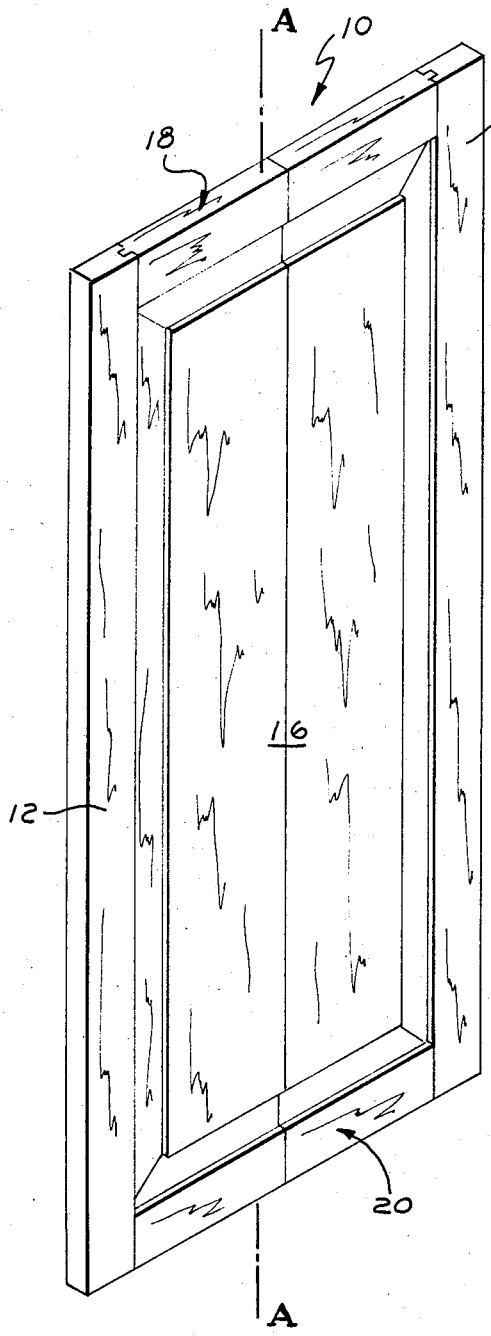
FIG. 1 is a perspective view of a standard-sized door constructed from modules made in accordance with the present invention.

Referring to the drawings in detail, FIG. 1 shows a solid door 10 having vertically oriented stiles 12, 14 at each side and a center panel 16 that fits into the stiles by tongue-and-groove arrangements, wherein the center panel is capped by upper and lower horizontal rails 18, 20 that are attached to both the panel and stiles by tongue-and-groove arrangements. The center panel 16 and horizontal rails 18, 20 are comprised of adjustable modules (see FIG. 2) that permit the width of the door to be easily reduced to fit the needs of a particular user.

Figure 2:
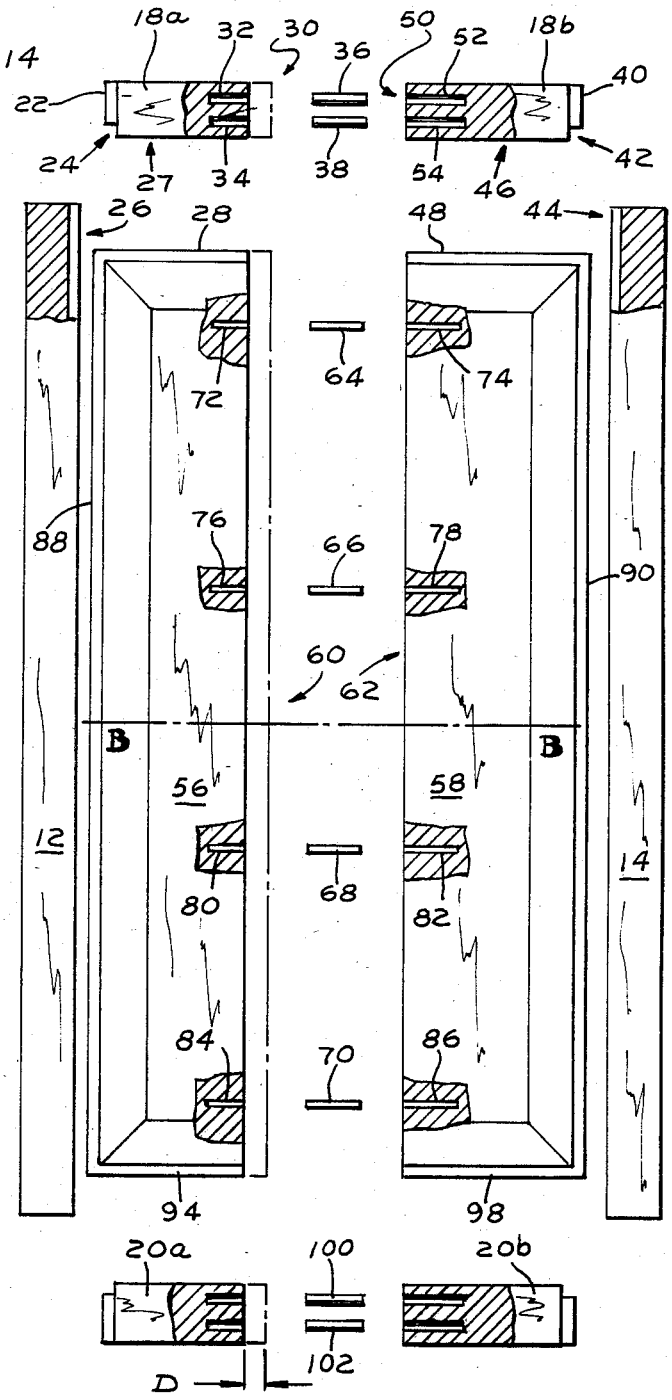
FIG. 2 is an exploded view, partly in cross section, showing adjustable modules used to construct the door. In it, a center portion of the left-hand modular sections is shown in phantom to illustrate a portion of the modules that can be trimmed along line A—A to form a smaller-sized door shown in FIGS. 3–4.

As best shown in FIG. 2, the modules for the top and bottom horizontal rails 18, 20 are duplicative of one another. Further, they each consist of mass-produced, left-hand and right-hand sections (18*a*, 18*b* of 18 and 20*a*, 20*b* of 20) that are made of wood and are virtually identical to one another.

As lined up in FIG. 2, the left-hand modular section 18*a* has a tongue 22 or rim at its outside end 24 for mating with a longitudinally extending groove 26 in the left-hand stile 12; a groove 27 on its underside for mating with an upper tongue portion 28 on top of the center panel 16 (see FIG. 6); and, an opposite or inside end 30 (opposite from the "tongue" end) with parallel, spaced bores that form channel halves 32, 34 for respectively housing left-hand portions of dowels 36, 38.

Right-hand modular section 18*b* is basically the same as the left-hand module 18*a* but rotated on a vertical axis 180° therefrom. It has a similar tongue 40 on its outside end 42 for mating with a longitudinally extending groove 44 in the right-hand stile 14; a groove 46 on its underside for mating with the upper tongue portion 48 on top of the center panel (see FIG. 2); and, an opposite or inside end 50 that has channel halves 52, 54 for housing the right-hand portions of dowels 36, 38. These channel halves are respectively identical to, and alignable with, the oppositely facing channel halves 32, 34 in the complemental end 30 or face of left-hand modular section 18*a*.

To join the modular sections 18*a*, 18*b* together, dowels 36, 38 are inserted approximately half way into the channel halves of either the right-hand module or the left (32, 34 or 52, 54), and the remaining modular section is slipped onto the dowels and pushed toward the first section until their complemental faces abut. Prior to doing so, glue is applied to the faces to hold them securely together once a desired size for the module has been selected. As will be apparent to those skilled in the art, the glue can be any suitable glue that will make the joint stronger than the wood itself.

Figure 4:
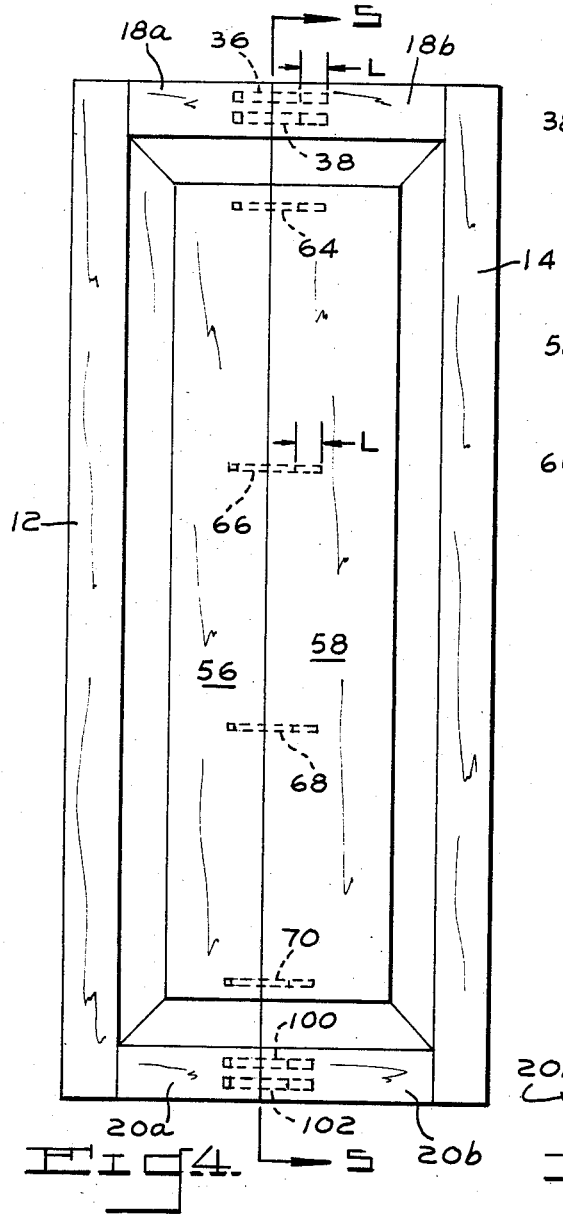
FIG. 4 is a front elevational view of the reduced door.
Figure 5:
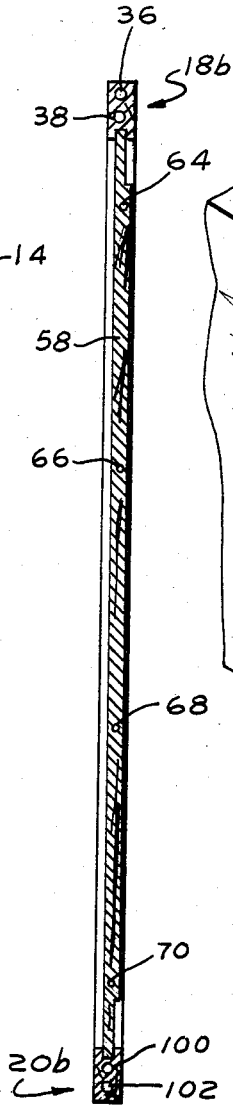
FIG. 5 is a cross-sectional view taken along line 5—5 of FIG. 4; and, FIG. 6 is an enlarged, fragmentary view of a top portion of the FIG. 5 door, showing modular sections of the top horizontal rail and an underlying center panel.
Figure 6:
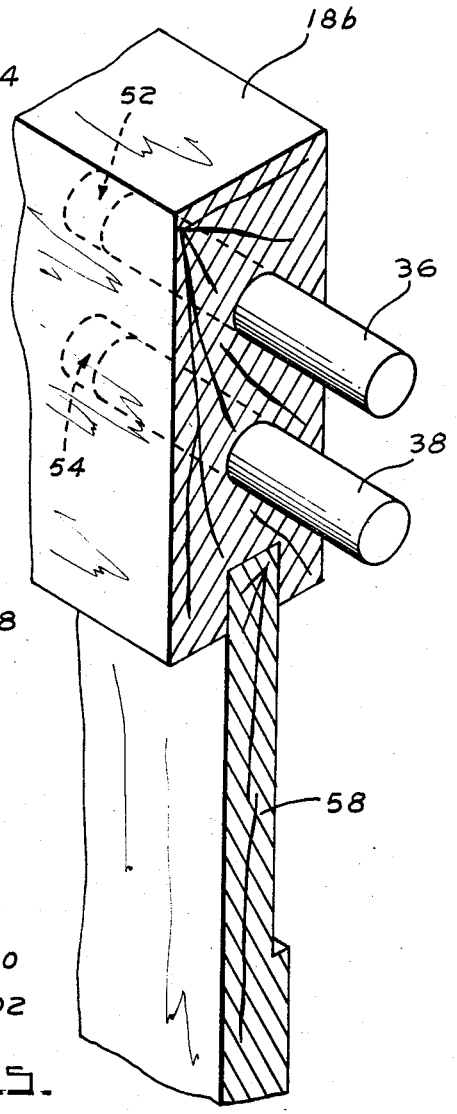

As best shown in FIGS. 2, 4 and 6, the channel halves 32, 34 and 52, 54 of both sections 18*a*, 18*b* are oversized in length so that the sections can be cut back at their complemental ends 30, 50 while still leaving enough of a length in the particular channel half to later house approximately one-half of its dowel 36 or 38. The total amount which the complemental ends can be cut back is twice the originally manufactured "overlength" dimension L of each section (see FIG. 4). When the sections are sliced or cut perpendicularly at their complemental ends, the ends are able to firmly abut as they would prior to cutting. Despite the module being reduced in size, its functional aspects along its assembled periphery, such as the tongues 22, 40 on its outside ends and the grooves 27, 46 on its underside remain unchanged. Further, any molding along the module's rim or tongue along its top would also look the same.

Below the top rail module 18 is the module for center panel 16. Like the top rail module, the center module has left-hand and right-hand sections 56, 58 that are joinable at oppositely facing, complemental ends 60, 62 by dowels 64, 66, 68, 70 that fit respectively into channel halves 72 and 74, 76 and 78, 80 and 82, and 84, 86 of the sections.

Both "center panel" sections 56, 58 are identical to one another, with each having an outside tongue 88, 90 for respectively engaging the longitudinal channels or grooves 26, 44 of stiles 12, 14. Further, each modular panel section has upper and lower tongues (28, 94 and 48, 98) along their outer peripheries. They mate with the grooves 26, 46 in the underside of the top rail module and similar grooves in the top surface of the bottom, horizontal rail module 20.

As with the channel halves of the rail modules 18, 20, the channel halves 72, 74, 76, 78, 80, 82, 84, 86 are oversized an equal amount "L". This permits the overall width of the center panel to be reduced a similar amount to both the top and bottom rails.

Continuing from top to bottom in FIG. 2, the lower horizontal rail module 20 is identical to, but upside-down from, the top horizontal rail module 18. Its left-hand modular section 20*a* and its right-hand section 20*b* correspond to modular sections 18*b*, 18*a* of the upper horizontal rail 18, and they are connected by dowels 100, 102.

Figure 3:
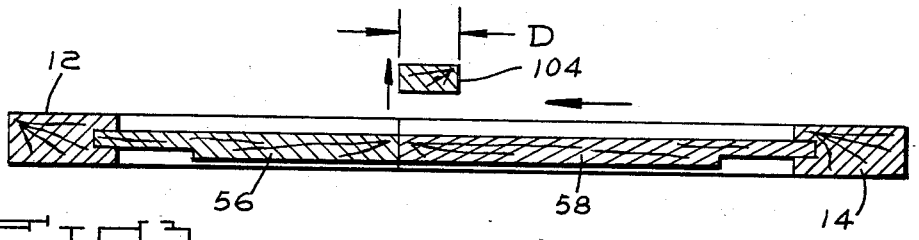
FIG. 3 is a cross-sectional view of the smaller door, wherein the overall width of the door is reduced from FIG. 1 by the size of the trimming or removed strip shown above it.

By utilizing the split-section aspect of the two-piece modules, the final product can be reduced from a standardized, manufactured size without detracting from its functional or ornamental aspects FIG. 2 shows a portion of the left-hand modular sections 18*a*, 56, 20*a* in phantom. This phantom portion represents a trimmed away portion of the modules along line A—A of FIG. 1. By cutting back the complemental face of each left-hand section this constant amount (dimension D in FIG. 2), the overall length of the modules are reduced an identical amount from their originally manufactured size. When the modules are then assembled, the width of the resulting door (see FIG. 3) would be reduced from its FIG. 1 door size by the trimmed or removed portion 104 shown in FIG. 3.

Though not shown, the height of the final product could also be adjusted by using a center panel module that was split not only vertically but horizontally as well, e.g., along line B—B of FIG. 2. In that instance, there would be upper and lower sections for each panel half 56, 58 shown in FIG. 2. These upper and lower sections would be joinable by any suitable means similar to that shown, namely, dowels that interconnect the sections by upper and lower channel halves (not shown).

If the panel sections were horizontally split, their overall height and the height of the door could be reduced by cutting back these upper and lower sections at their complemental, horizontal center faces. The stiles would also have to be cut back the same amount at one end in order for the height of the assembled pieces to match exactly.

While the above-described modules have been depicted in a single, final product (door 10), it should be understood that this depiction is strictly for an example of the broad usage of the present invention. The invention concerns itself with the concept of using this type of adjustable module in a variety of products and not necessarily with the products themselves.

For example, the same concept could be used to make adjustable-sized drawers from standard "Adjustable Modules". By making the front and back panels of the drawer out of two-piece adjustable modules, the width of the drawer can be reduced from a standardized size. Similarly, the length of each drawer could also be adjustable, prior to assembly, by using modules for forming the sides. In either event, reducing would not affect any prefabricated corner joints of the drawers, such as dovetail cutouts because the modules would be reduced by trimming them away at their centers instead of at their ends where the joints are located.

It will be understood by those skilled in the art that obvious structural modifications can be made without departing from the spirit of the invention. For example, although the above-described modules were described as being made of wood, they could, of course, be made of any suitable material, such as aluminum or even plastic. Accordingly, reference should be made primarily to the appended claims, rather than the foregoing specification, to determine the scope of the invention.

Having thus described the invention, what is claimed is:

1. A method of building a final product of desired size from a set of adjustable modules, said method comprising:

(a) joining left-hand and right-hand, longitudinally extending modular sections at abutting, substantially squared, complemental ends by placing dowels into aligned channel halves in the complemental faces of the two sections, wherein the channel halves are each initially oversized to house more than one-half of its respective dowel;

(b) reducing the overall length of the module and the final product itself without destroying any functional aspects along the module's rim by trimming away the complemental ends prior to joining them together; and, (c) attaching the module to another piece by a functional cooperation along their rims.

2. The method of claim 1 wherein the functional cooperation is a tongue-and-groove arrangement.

3. The method of claim 1 further including the step of using a plurality of interconnected modules to build the final product, wherein each of the modules has left-hand and right-hand modular sections that are joined at abutting, substantially squared, complemental ends by placing dowels into aligned channel halves in the complemental faces of the two sections.

4. The method of claim 1 wherein at least one of the modules is split horizontally into upper and lower portions, wherein the method further includes the step of reducing the height of the final product without destroying the functional aspects along the assembled module's rim by trimming away oppositely facing, complemental faces of the upper and lower portions prior to joining them together.

* * * * *